US007674134B2

(12) United States Patent
Yamaji et al.

(10) Patent No.: US 7,674,134 B2
(45) Date of Patent: Mar. 9, 2010

(54) SHIELDED CONNECTOR

(75) Inventors: Takahiro Yamaji, Tokyo (JP); Kazukuni Hisatomi, Tokyo (JP); Koji Hayashi, Tokyo (JP); Masakazu Kuroiwa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/154,830

(22) Filed: May 27, 2008

(65) Prior Publication Data

US 2009/0011646 A1 Jan. 8, 2009

(30) Foreign Application Priority Data

May 28, 2007 (JP) ..... 2007-140807

(51) Int. Cl.
*H01R 13/648* (2006.01)

(52) U.S. Cl. ..... 439/607.53; 439/496

(58) Field of Classification Search ..... 439/495–497, 439/607, 607.53, 607.1, 628, 67, 493, 676
See application file for complete search history.

(56) References Cited

U.S. PATENT DOCUMENTS

| | | | | |
|---|---|---|---|---|
| 5,788,537 | A * | 8/1998 | Davis et al. | 439/607 |
| 6,250,959 | B1 * | 6/2001 | Yamaguchi et al. | 439/578 |
| 6,375,488 | B1 * | 4/2002 | Noro | 439/395 |
| 6,544,050 | B1 * | 4/2003 | Ko | 439/108 |
| 6,705,893 | B1 * | 3/2004 | Ko | 439/607 |
| 7,112,087 | B2 | 9/2006 | Tago et al. | |
| 7,354,300 | B2 * | 4/2008 | Shindo | 439/497 |
| 7,465,186 | B2 * | 12/2008 | Yotsutani | 439/497 |
| 2005/0106932 | A1 | 5/2005 | Miyazawa | |
| 2007/0054556 | A1 | 3/2007 | Fukushima et al. | |
| 2007/0066142 | A1 | 3/2007 | Shindo | |

FOREIGN PATENT DOCUMENTS

| | | |
|---|---|---|
| EP | 1 320 149 | 6/2003 |
| EP | 1 484 823 | 12/2004 |
| EP | 1 646 113 | 4/2006 |
| JP | 2003-331993 | 11/2003 |
| JP | 2004-362827 | 12/2004 |

OTHER PUBLICATIONS

Japanese Office Action dated Feb. 18, 2009.

* cited by examiner

*Primary Examiner*—Edwin A. Leon
*Assistant Examiner*—Vanessa Girardi
(74) *Attorney, Agent, or Firm*—Collard & Roe, P.C.

(57) ABSTRACT

In a connector including a conductive contact, an insulating housing holding the contact, and a conductive shell covering the housing, the housing includes a protruding portion of a flat-plate shape having first and second principal surfaces faced to each other. The contact includes a first contacting portion disposed on the first principal surface of the protruding portion and a second contacting portion extending from the first contacting portion to the second principal surface of the protruding portion. The shell includes a shell contacting portion disposed on the second principal surface of the protruding portion. The second contacting portion and the shell contacting portion have confronting end faces faced to each other.

11 Claims, 1 Drawing Sheet

SHIELDED CONNECTOR

This application is based upon and claims the benefit of priority from Japanese patent application No. 2007-140807, filed on May 28, 2007, the disclosure of which is incorporated herein in its entirely by reference.

TECHNICAL FIELD

This invention relates to a connector called a plug or a receptacle and to a connection apparatus using two connectors of the type.

BACKGROUND ART

A connection apparatus of the type is disclosed, for example, in Japanese Unexamined Patent Application Publication (JP-A) No. 2004-362827. The connection apparatus includes two connectors adapted to be connected to each other. One of the connectors comprises a plurality of conductive contacts, an insulating housing holding the contacts, and a conductive shell covering the housing. The housing has a protruding portion. The contacts are extended and exposed on one surface of the protruding portion. Each of the contacts is bent in a crank-like shape in the vicinity of its end portion to be exposed on the other surface of the protruding portion and forms two contact points on the side of the one and the other surfaces, respectively. The other connector also has a plurality of conductive contacts. Each of the contacts of the other connector has a bifurcated shape having two branches different in length from each other and has two contact points.

When these connectors are connected to each other, the two contact points of each contact of the one connector are contacted with the two contact points of each contact of the other connector. Thus, when the connectors are connected to each other, electrical connection is established at two positions shifted in position from each other in a connecting direction.

SUMMARY OF THE INVENTION

In JP-A-2004-362827, the other connector has no shell. An electromagnetic shielding effect is expected exclusively by the shell of the one connector. However, it is not easy to obtain a sufficient electromagnetic shielding effect only by the shell of the one connector.

Even if both of the connectors are provided with shells, an excellent electromagnetic shielding effect can not be achieved unless these shells are grounded in a good/favorable/preferable condition.

It is therefore an exemplary object of this invention to provide a connector and a connection apparatus which are expected to achieve an excellent electromagnetic shielding effect in a connected state.

It is another exemplary object of this invention to provide a connector and a connection apparatus which have high reliability of connection.

Other objects of the present invention will become clear as the description proceeds.

According to a first exemplary aspect of the present invention, there is provided a connector comprising a contact which is conductive, a housing which is of insulation and holds the contact, and a shell which is conductive and covers the housing, wherein the housing includes a protruding portion of a flat-plate shape having first and second principal surfaces which are faced to each other, the contact includes a first contacting portion which is disposed on the first principal surface of the protruding portion; and a second contacting portion which extends from the first contacting portion to the second principal surface of the protruding portion, the shell includes a shell contacting portion which is disposed on the second principal surface of the protruding portion, and the second contacting portion and the shell contacting portion have confronting end faces which are faced to each other.

According to a second exemplary aspect of the present invention, there is provided a connector comprising a contact which is conductive, an housing which is of insulation and holds the contact, and a shell which is conductive and covers the housing, wherein the contact includes a first contacting portion and a second contacting portion which extend away from each other, the shell includes a shell contacting portion which is disposed on an inner surface of the housing, and the second contacting portion and the shell contacting portion have confronting end faces which are faced to each other.

According to a third exemplary aspect of the present invention, there is provided a connection apparatus including first and second connectors adapted to be connected to each other, wherein the first connector comprises a contact which is conductive, a housing which is of insulation and holds the contact of the first connector, and a shell which is conductive and covers the housing of the first connector, wherein the housing of the first connector includes a protruding portion of a flat-plate shape having first and second principal surfaces which are faced to each other, the contact of the first connector includes a first contacting portion which is disposed on the first principal surface of the protruding portion, and a second contacting portion extends from the first contacting portion to the second principal surface of the protruding portion, the shell of the first connector includes a shell contacting portion which is disposed on the second principal surface of the protruding portion, and the second contacting portion and the shell contacting portion in the first connector have confronting end faces which are faced to each other, wherein the second connector comprises a contact which is conductive, a housing which is of insulation and holds the contact of the second connector, and a shell which is conductive and covers the housing of the second connector, and wherein the contact of the second connector includes a first contacting portion and a second contacting portion which extend away from each other, the shell of the second connector includes a shell contacting portion which is disposed on an inner surface of the housing of the second connector and adapted to be contacted with the shell contacting portion of the first connector when the first and the second connectors are connected to each other, and the second contacting portion and the shell contacting portion have confronting end faces in the second connector which are spaced from and faced to each other.

DESCRIPTION OF THE EXEMPLARY EMBODIMENTS

Figure 1:
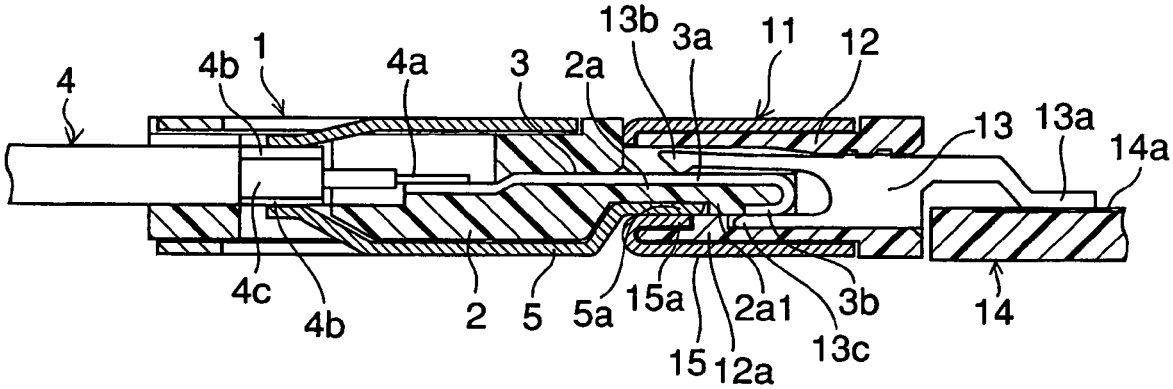
FIG. 1 is a sectional view of a connection apparatus according to a first exemplary embodiment of this invention in a connected state.

Referring to FIG. 1, description will be made of a connection apparatus according to a first exemplary embodiment of this invention.

The connection apparatus illustrated in FIG. 1 comprises a plug connector 1 and a receptacle connector 11 adapted to be fitted and connected to the plug connector 1 in a connecting direction.

The plug connector 1 comprises an insulating housing 2, a number of conductive signal contacts 3 held by the housing 2 and arranged at a predetermined pitch in a direction perpendicular to the drawing sheet, a cable 4 having a number of signal conductor wires 4*a* connected to the signal contacts 3, respectively, and a conductive shell 5 covering the signal contacts 3, the signal conductor wires 4*a*, and the housing 2. The shell 5 is connected to a pair of ground plates 4*b* connected by soldering to a shield 4*c* of the cable 4. The ground plates 4*b* are arranged on upper and lower sides of the cable 4 and clamp the shield 4*c* of the cable 4.

The housing 2 has a protruding portion (fitting portion) 2*a* of a flat-plate shape on which contacting portions of the signal contacts 3 are disposed. The contacting portion of each signal contact 3 has a first contacting portion (upper contact point) 3*a* disposed on an upper surface or first principal surface of the protruding portion 2*a*, and a second contacting portion 3*b* extending from the first contacting portion 3*a* along an outer surface of the protruding portion 2*a* in a generally U shape to reach a lower surface or second principal surface of the protruding portion 2*a*. A part of the second contacting portion 3*b* which is positioned on the other surface of the protruding portion 2*a* is called a lower contact point.

The shell 5 has at least one shell contacting portion (shell contact point) 5*a* disposed on the other surface of the protruding portion 2*a*. The second contacting portion 3*b* has an end face faced to that of the shell contacting portion 5*a* in the connecting direction. A projection 2*a*1 formed on the other surface of the protruding portion 2*a* is interposed between the end faces of the second contacting portion 3*b* and the shell contacting portion 5*a*.

The receptacle connector 11 comprises an insulating housing 12, a number of conductive signal contacts 13 held by the housing 12 and arranged at a predetermined pitch in the direction perpendicular to the drawing sheet, a substrate 14 having a number of pads 14*a* connected to terminal portions 13*a* of the signal contacts 13, and a conductive shell 15 covering the signal contacts 13 and the housing 12.

Each of the signal contacts 13 has a bifurcated shape having two branches different in length from each other. Each signal contact 13 has the terminal portion 13*a*, a first contacting portion (upper contact point) 13*b* disposed on an inner surface of the housing 12, and a second contacting portion (lower contact point) 13*c*. The first and the second contacting portions 13*b* and 13*c* are shifted in position from each other in the connecting direction of the plug connector 1 and the receptacle connector 11.

The shell 15 has a lower part extended into a generally U shape to form a shell contacting portion (shell contact point) 15*a* disposed on an inner surface of a lower part of the housing 12. The second contacting portion 13*c* has an end face faced to that of the shell contacting portion 15*a* in the connecting direction. A projection 12*a* formed on the inner surface of the lower part of the housing 12 is interposed between the end faces of the first contacting portion 13*c* and the shell contacting portion 15*a*.

When the plug connector 1 and the receptacle connector 11 are fitted to each other, the first and the second contacting portions 3*a* and 3*b* of each signal contact 3 of the plug connector 1 are contacted with the first and the second contacting portions 13*b* and 13*c* of each signal contact 13 of the receptacle connector 11, respectively. Simultaneously, the shell contacting portion 5*a* of the shell 5 of the plug connector 1 is contacted with the shell contacting portion 15 of the shell 15 of the receptacle connector 11. Thus, the plug connector 1 and the receptacle connector 11 are connected at three points so that a well-balanced connected state of the connectors is assured.

Since the shell contacting portion 15*a* of the shell 15 is flush with the second contacting portion 13*c* of each signal contact 13, the connection apparatus can be reduced in profile. Furthermore, since the shell contacting portion 5*a* of the shell 5 is flush with the second contacting portion 3*b* of each signal contact 3, the connection apparatus can be reduced in profile.

Next referring to FIG. 2, description will be made of a connection apparatus according to a second exemplary embodiment of this invention. Similar parts are designated by like reference numerals and description thereof will be omitted.

Figure 2:
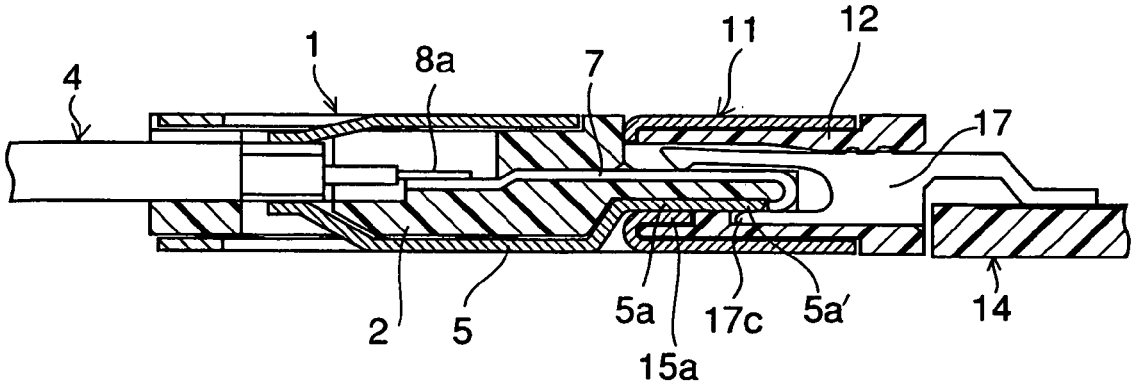
FIG. 2 is a sectional view of a connection apparatus according to a second exemplary embodiment of this invention in a connected state.

In FIG. 2, the plug connector 1 and the receptacle connector 11 are different from those illustrated in FIG. 1 in that a predetermined number of the signal contacts 3 of the plug connector 1 and a predetermined number of the signal contacts 13 of the receptacle connector 11 are replaced by ground contacts 7 and ground contacts 17, respectively. Thus, in the connection apparatus illustrated in FIG. 2, the signal contacts and the ground contacts are used. The ground contacts 7 of the plug connector 1 in FIG. 2 are connected to ground conductor wires 8*a*, respectively.

The plug connector 1 in the connection apparatus illustrated in FIG. 2 is different from that illustrated in FIG. 1 in the following respects. At a part corresponding to a position of each ground contact 7, the projection 2*a*1 of the plug connector 1 in FIG. 1 is removed. In addition, only at the part corresponding to the position of each ground contact 7, the shell 5 is extended to form a shell contacting portion 5*a*' connected to a second contacting portion (lower contact point) 17*c* of each ground contact 17. Specifically, the shell contacting portion 5*a* is at a position faced to the signal contact 3 as illustrated in FIG. 1 while the shell contacting portion 5*a*' is at a position faced to the ground contact 7 as illustrated in FIG. 2. An end face of the shell contacting portion 5*a*' may be contacted with and connected to an end face of each ground contact 7.

A projection 12*a* may be removed like the projection 2*a*1 of the plug connector 1 and the end face of the shell contacting portion 15*a* may be extended towards an end face of the second contacting portion (lower contact point) 17*c* of the ground contact 17. Thus, the shell contacting portion 15*a* at a position corresponding to each ground contact 17 of the receptacle connector 11 may have a structure similar to that of the shell contacting portion 5*a*' of the plug connector 1.

Various exemplary embodiments of this invention will be enumerated in the following items 1-13.

1. A connector 1 comprising a contact 3 which is conductive, a housing 2 which is of insulation and holds the contact 3, and a shell 5 which is conductive and covers the housing 2, wherein the housing includes a protruding portion 2*a* of a flat-plate shape having first and second principal surfaces which are faced to each other, the contact 3 includes a first contacting portion 3*a* which is disposed on the first principal surface of the protruding portion and a second contacting portion 3*b* which extends from the first contacting portion to the second principal surface of the protruding portion 2*a*, the shell includes a shell contacting portion 5*a* which is disposed on the second principal surface of the protruding portion 2*a*, and the second contacting portion 3*b* and the shell contacting portion 5*a* have confronting end faces which are faced to each other.

2. The connector according to the item 1, wherein the second contacting portion 3*b* has a generally U shape and is fitted to a part of the protruding portion 2*a*.

3. The connector according to the item 2, wherein the second contacting portion 3*b* is fitted to an end portion of the protruding portion 2*a* in a protruding direction thereof.

4. The connector according to the item 1, wherein the contact is a signal contact 3 and the confronting end faces are separated from each other.

5. The connector according to the item 4, wherein the protruding portion 2*a* includes a projection 2*a*1 which is interposed between the confronting end faces.

6. The connector according to the item 1, wherein the contact is a ground contact 7 and the confronting end faces are contacted with each other.

7. A connector 11 comprising a contact 13 which is conductive, an housing 12 which is of insulation and holds the contact 13, and a shell 15 which is conductive and covers the housing 12, wherein the contact 13 includes a first contacting portion 13*b* and a second contacting portion 13*c* which extend away from each other, the shell 15 includes a shell contacting portion 15*a* which is disposed on an inner surface of the housing 12, and the second contacting portion 13*c* and the shell contacting portion 15*a* have confronting end faces which are faced to each other.

8. The connector according to the item 7, wherein the confronting end faces are separated from each other.

9. The connector according to the item 8, wherein the housing 12 includes a projection 12*a* which is interposed between the confronting end faces.

10. The connector according to the item 7, wherein the first and the second contacting portions 13*b* and 13*c* are shifted in position from each other in a connecting direction of the connector.

11. A connection apparatus including first and second connectors 1 and 11 adapted to be connected to each other, wherein the first connector 1 comprises a contact 3 which is conductive, a housing 2 which is of insulation and holds the contact 3 of the first connector 1, and a shell 5 which is conductive and covers the housing 2 of the first connector 1, wherein the housing 2 of the first connector 1 includes a protruding portion 2*a* of a flat-plate shape having first and second principal surfaces which are faced to each other; the contact 3 of the first connector 1 includes a first contacting portion 3*a* which is disposed on the first principal surface of the protruding portion 2*a* and a second contacting portion 3*b* extends from the first contacting portion 3*a* to the second principal surface of the protruding portion 2*a*, the shell 5 of the first connector 1 includes a shell contacting portion 5*a* which is disposed on the second principal surface of the protruding portion 2*a*, and the second contacting portion 3*b* and the shell contacting portion 5*a* in the first connector 1 have confronting end faces which are faced to each other, wherein the second connector 11 comprises a contact 13 which is conductive, a housing 12 which is of insulation and holds the contact 13 of the second connector 11, and a shell 15 which is conductive and covers the housing 12 of the second connector 11, and wherein the contact 13 of the second connector 11 includes a first contacting portion 13*b* and a second contacting portion 13*c* which extend away from each other, the shell 15 of the second connector 11 includes a shell contacting portion 5*a* which is disposed on an inner surface of the housing 12 of the second connector 11 and adapted to be contacted with the shell contacting portion 5*a* of the first connector 1 when the first and the second connectors 1 and 11 are connected to each other, and the second contacting portion 13*c* and the shell contacting portion 15*a* in the second connector 11 have confronting end faces which are spaced from and faced to each other.

12. The connection apparatus according to the item 11, wherein the contact 3 of the first connector 1 is a signal contact, and the first and the second contacting portions 3*a* and 3*b* of the first connector 1 are contacted with the first and the second contacting portions 13*b* and 13*c* of the second connector 11, respectively, when the first and the second connectors 1 and 11 are connected to each other.

13. The connection apparatus according to the item 11, wherein the contact 3 of the first connector 1 is a ground contact, and the first contacting portion 3*a* and the shell contacting portion 5*a* in the first connector 1 are contacted with the first and the second contacting portions 13*b* and 13*c* of the second connector 11, respectively, when the first and the second connectors 1 and 11 are connected to each other.

Each of the above-mentioned connection apparatuses exhibits the following effects.

When the plug connector and the receptacle connector are fitted to each other, they are reliably connected at three points. Both of the connectors can be formed into a low profile. Since a portion of the shell is also connected to the ground contact of a mating connector, grounding can be more effectively performed.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

What is claimed is:

1. A connector comprising:

a contact which is conductive;

a housing which is of insulation and holds the contact; and a shell which is conductive and covers the housing;

wherein the housing includes a protruding portion of a flat-plate shape having opposite and parallel first and second principal surfaces;

the contact includes:

a first contacting portion which is disposed on the first principal surface of the protruding portion; and a second contacting portion which extends from the first contacting portion to the second principal surface of the protruding portion;

the shell includes a shell contacting portion which is disposed on the second principal surface of the protruding portion; and the second contacting portion and the shell contacting portion have confronting end faces which are faced to each other.

2. The connector according to claim 1, wherein the contact is a ground contact and the confronting end faces are contacted with each other.

3. The connector according to claim 1, wherein the second contacting portion has a generally U shape and is fitted to a part of the protruding portion.

4. The connector according to claim 3, wherein the second contacting portion is fitted to an end portion of the protruding portion in a protruding direction thereof.

5. The connector according to claim 1, wherein the contact is a signal contact and the confronting end faces are separated from each other.

6. The connector according to claim 5, wherein the protruding portion includes a projection which is interposed between the confronting end faces.

7. A connector comprising:

a contact which is conductive;

a housing which is of insulation and holds the contact; and a shell which is conductive and covers the housing;

wherein the contact includes a first contacting portion and a second contacting portion which extend away from each other;

the shell includes a shell contacting portion;

the second contacting portion and the shell contacting portion have confronting end faces which are faced to and separated from each other; and the housing includes a projection which is interposed between the confronting end faces.

8. The connector according to claim 7, wherein the first and the second contacting portions are shifted in position from each other in a connecting direction of the connector.

9. A connection apparatus including first and second connectors adapted to be connected to each other, wherein the first connector comprises:

a contact which is conductive;

a housing which is of insulation and holds the contact of the first connector; and a shell which is conductive and covers the housing of the first connector;

wherein the housing of the first connector includes a protruding portion of a flat-plate shape having opposite and parallel first and second principal surfaces;

the contact of the first connector includes:

a first contacting portion which is disposed on the first principal surface of the protruding portion; and a second contacting portion extends from the first contacting portion to the second principal surface of the protruding portion;

the shell of the first connector includes a shell contacting portion which is disposed on the second principal surface of the protruding portion; and the second contacting portion and the shell contacting portion in the first connector have confronting end faces which are faced to each other;

wherein the second connector comprises:

a contact which is conductive;

a housing which is of insulation and holds the contact of the second connector; and a shell which is conductive and covers the housing of the second connector; and wherein the contact of the second connector includes a first contacting portion and a second contacting portion which extend away from each other;

the shell of the second connector includes a shell contacting portion which is disposed on an inner surface of the housing of the second connector and adapted to be contacted with the shell contacting portion of the first connector when the first and the second connectors are connected to each other; and the second contacting portion and the shell contacting portion have confronting end in the second connector faces which are spaced from and faced to each other.

10. The connection apparatus according to claim 9, wherein the contact of the first connector is a signal contact, and the first and the second contacting portions of the first connector are contacted with the first and the second contacting portions of the second connector, respectively, when the first and the second connectors are connected to each other.

11. The connection apparatus according to claim 9, wherein the contact of the first connector is a ground contact, and the first contacting portion and the shell contacting portion in the first connector are contacted with the first and the second contacting portions of the second connector, respectively, when the first and the second connectors are connected to each other.

* * * * *